US009636724B2

(12) United States Patent
Hermes et al.

(10) Patent No.: US 9,636,724 B2
(45) Date of Patent: May 2, 2017

(54) METHOD FOR HOT ROLLING Z-SECTIONS SHEET PILES

(75) Inventors: Aloyse Hermes, Differdange (LU); François Robinet, Lottert (BE)

(73) Assignee: ArcelorMittal Investigación Y Desarrollo S.L., Sestao (Bizkaia) (ES)

( * ) Notice: Subject to any disclaimer, the term of this patent is extended or adjusted under 35 U.S.C. 154(b) by 15 days.

(21) Appl. No.: 14/389,986

(22) PCT Filed: Apr. 2, 2012

(86) PCT No.: PCT/IB2012/000658

§ 371 (c)(1),
(2), (4) Date: Oct. 1, 2014

(87) PCT Pub. No.: WO2013/150324

PCT Pub. Date: Oct. 10, 2013

(65) Prior Publication Data

US 2015/0052961 A1 Feb. 26, 2015

(51) Int. Cl.

| | |
|---|---|
| ***B21B 1/09*** | (2006.01) |
| ***B21B 1/098*** | (2006.01) |
| ***B21B 1/082*** | (2006.01) |

(52) U.S. Cl.

CPC ..... *B21B 1/098* (2013.01); *B21B 1/082* (2013.01)

(58) Field of Classification Search

CPC .. B21B 1/08; B21B 1/082; B21B 1/09; B21B 1/095; B21B 1/098

See application file for complete search history.

(56) References Cited

U.S. PATENT DOCUMENTS

| | | | | |
|---|---|---|---|---|
| 4,291,564 | A | 9/1981 | Muckli | |
| 5,671,630 | A | 9/1997 | Grober | |
| 6,293,133 | B1 * | 9/2001 | Svejkovsky et al. | 72/225 |

FOREIGN PATENT DOCUMENTS

| | | | |
|---|---|---|---|
| DE | 121718 | A5 | 8/1976 |
| DE | 2529405 | A1 | 8/1976 |
| EP | 0 284 827 | A2 | 10/1988 |
| EP | 0 890 395 | A1 | 1/1999 |
| GB | 2018656 | A | 10/1979 |
| JP | H04288903 | A | 10/1992 |
| JP | H07124602 | A | 5/1995 |
| JP | 2004-288903 | A | 10/2004 |

* cited by examiner

*Primary Examiner* — Debra Sullivan
(74) *Attorney, Agent, or Firm* — Reinhart Boerner Van Deuren P.C.

(57) ABSTRACT

A method for rolling a Z-section sheet pile comprises rolling a curved preform of a web (16) in successive roll gaps defined by at least one roll pair comprising a grooved upper roll (26) and a grooved lower roll (28), wherein: a first corner (18) and an adjoining first part of the curved preform of the web (16) are formed in a first groove (42) of an upper roll (26); and a second corner (20) and an adjoining second part of the curved preform of the web (16) are formed in a first groove (46) of a lower roll (28). In the last roll gaps forming the curved preform of the web (16), the diameter of the lower roll (28) decreases in a discontinuous manner in the interval between the first groove (42) in the upper roll (26) and the first groove (46) in the lower roll (26), and the diameter of the upper roll (26) increases in this interval in a complementary manner.

19 Claims, 4 Drawing Sheets

METHOD FOR HOT ROLLING Z-SECTIONS SHEET PILES

TECHNICAL FIELD

The present invention generally relates to a method for hot rolling Z-section sheet piles.

BACKGROUND ART

Steel sheet piles are long structural sections provided with an interlocking system that allows building continuous retaining walls. The most common sheet pile sections are: Z-sections, U-sections, Ω-sections, flat-web sections and H or double-T sections.

Z-section sheet piles include a first flange, a second flange, which is substantially parallel to the first flange, an inclined web, a first corner joining the web to the first flange, a second corner joining the web to the second flange, wherein each of the corners has an opening angle α greater than 90°, preferably in the range of 110° to 140°. The longitudinal edges of the flanges are generally equipped with coupling means for interlocking purposes. In distinct contrast to other sheet pile sections, Z-section sheet piles do not have a plane of symmetry.

It is well known in the art to produce Z-section sheet piles by a hot rolling process, starting from slabs or, more recently, from beam blanks. Different methods for hot rolling Z-section sheet piles are e.g. disclosed in following documents: U.S. Pat. No. 4,291,564, EP 0284827 A2, EP 0890395 A1, DE 2529405 A, JP 4/288903 A and U.S. Pat. No. 5,671,630.

U.S. Pat. No. 5,671,630 discloses a method for rolling such Z-section sheet piles from a beam blank. According to this method, a preform of the sheet pile is rolled with curved preforms of the web and the flanges. The curved preform of the web comprises: two web/flange transition sections, which are substantially flat sections parallel to the rolling plane; a middle section, which is a substantially flat section defining an angle of about 60° with the rolling plane; and two connecting bows, connecting the web/flange transition sections to the oblique middle section. The substantially "J"-shaped preforms of the flanges allow rolling the coupling means close to the neutral rolling plane. In a last rolling step, the curved preforms of the web and the flanges are straightened to form the finished Z-section sheet pile.

It is well known in the art that grooved rolls used for rolling Z-section sheet-piles have a relatively short lifetime. Due to the absence of mirror symmetry in their section, one has to produce one side of the Z-section sheet pile in a deep groove of the upper roll and the other side in a deep groove of the lower roll. Such extreme roll gap contours result in that the roll surfaces are rapidly worn out and in that possibilities for their reworking are rather limited. They also increase the risk of a roll fracture.

There is consequently a need for a method for rolling a Z-section sheet pile in which the rolls have a longer lifetime and are less exposed to a roll fracture.

SUMMARY OF INVENTION

The invention proposes a method for hot rolling a Z-section sheet pile having a first flange, a second flange, which is substantially parallel to the first flange, an inclined web, a first corner joining the web to the first flange, a second corner joining the web to the second flange, wherein each of the corners has an opening angle α greater than 90°, preferably in the range of 110° to 140°. The proposed method comprises the steps of: (1) rolling a curved preform of the web in successive roll gaps defined by at least one roll pair comprising a grooved upper roll and a grooved lower roll, wherein a preform of the first corner and an adjoining first part of the curved preform of the web are formed in a first groove of the upper roll, in which the latter has e.g. its minimum diameter, and a preform of the second corner and an adjoining second part of the curved preform of the web are formed in a first groove of the lower roll, in which the latter has e.g. its minimum diameter; and (2) subsequently straightening the curved preform of the web between an upper straightening roll and a lower straightening roll. In accordance with one aspect of the present invention, at least in the last roll gaps rolling the curved preform of the web, the diameter of the lower roll decreases in a discontinuous manner in the interval between the first groove in the upper roll and the first groove in the lower roll, and the diameter of the upper roll increases in a complementary manner. Decreasing in a discontinuous manner means that the diameter of the lower roll does not continuously decrease; i.e. there are intermediate portions of the lower roll in the concerned interval, in which the initially decreasing diameter stays substantially constant, and/or in which it increases before it decreases again. In other words, in the interval between the first groove in the upper roll and the first groove in the lower roll, the diameter of the lower roll decreases e.g. in a stepped manner and/or in an undulated manner. It follows that less vertical space is required for rolling the preform of the web; i.e. the minimum diameters of the two rolls may be bigger than with any prior art method of rolling Z-shaped sheet-piles. Consequently, the roll gap contour can be reworked more often, before the minimum diameters of the rolls decrease beyond a limit value. Furthermore, less deep grooves in the rolls also result in smaller rolling torques and in more equal surface speeds along the roll gap contour, i.e. in less mechanical wear of the surfaces of the rolls. In summary, with the proposed method, the rolls wear out less faster and must be reworked less often, but—due to a bigger minimum diameter—can even be reworked more often than with any prior art method for rolling Z-section sheet piles. Last but not least, less deep grooves in the rolls also substantially reduce the risk of a roll fracture. Consequently, with the proposed method, expected total life-time of the rolls can be substantially increased. Finally, it will further be appreciated that the proposed method allows using a relatively thin slab as a starting product for rolling a Z-section sheet pile.

In a preferred embodiment, the diameter of the lower roll decreases, in the interval between the first groove in the upper roll and the first groove in the lower roll, in a an undulated manner, so as to have in this interval at least one intermediate maximum value and one intermediate minimum value. This means e.g. that a third part of the curved preform of the web, which is located between the first part and the second part, is formed partly in a second groove of the lower roll, and partly in a second groove of the upper roll. Due to the fact that rolling of the curved preform of the web is allotted onto at least two grooves in the upper roll and at least two grooves in the lower roll, these grooves may be less deep, i.e. the minimum diameters of the two rolls may be bigger.

In a further embodiment, in the interval between the first groove in the upper roll and the first groove in the lower roll, the diameter of the lower roll decreases then stays constant, before further decreasing. This means e.g. that a third part of the curved preform of the web, which is located between the first part and the second part, is formed between substantially cylindrical portions of the upper roll and the lower roll. Due to the fact that the middle section of the curved preform of the web is rolled—at least partly—between substantially cylindrical roll sections, less vertical space is required for rolling the preform of the web; i.e. the minimum diameters of the two rolls may be bigger than with any prior art method of rolling Z-shaped sheet-piles.

If the centre line of a roll is defined as being the axis (line) about which the roll rotates (i.e. the line passing through the centres of the two bearing journals of the roll) and the nominal diameter of a roll in a roll pair is defined as being the minimum vertical distance between the centre lines of the rolls of the roll pair, the minimum diameter of the lower roll in its—aforementioned—second groove is preferably smaller than the nominal diameter of the lower roll and preferably bigger than the minimum diameter of the lower roll in its first groove; and/or the minimum diameter of the upper roll in its—aforementioned—second groove is preferably smaller than the nominal diameter of the upper roll and preferably bigger than the minimum diameter of the upper roll in its first groove.

Furthermore, if:

Dmin(URG1) is the minimum diameter of the upper roll in its first groove;

Dmin(URG2) is the minimum diameter of the upper roll in its second groove;

Dmin(LRG1) is the minimum diameter of the lower roll in its first groove;

Dmin(LRG2) is the minimum diameter of the lower roll in its second groove; and

Dnom is the nominal diameter of the upper lower and the lower roll;

then following relations between theses diameters are preferably satisfied:

$$[D\text{nom}-D\text{min}(\text{URG2})]<k\cdot[D\text{nom}-D\text{min}(\text{URG1})]$$

and/or $$[D\text{nom}-D\text{min}(\text{LRG2})]<k\cdot[D\text{nom}-D\text{min}(\text{LRG1})].$$

wherein k is preferably smaller than 1, more preferably smaller than or equal to 0.5 and, in a preferred embodiment, equal to 0.2.

If:

Dmin(UR) is the minimum diameter of the upper roll;

Dmin(LR) is the minimum diameter of the lower roll; and

E(CC) is the minimum vertical distance between the centre lines of the upper roll and the lower roll; and w is the overall horizontal width of the roll gap contour;

then following relations between theses parameters are preferably satisfied:

$$\{w/[E(CC)-(D\text{min}(\text{UR})+D\text{min}(\text{LR}))/2]\}>3.5$$

and preferably $$\{w/[E(CC)-(D\text{min}(\text{UR})+D\text{min}(\text{LR}))/2]\}>4.$$

In a preferred embodiment, in the first groove of the upper roll and/or lower roll, the bottom surface is formed by a substantially cylindrical surface; and/or in the second groove (if present) of the upper roll and/or lower roll, the bottom surface is formed by a concavely curved surface.

In a preferred embodiment: in the first groove of the upper roll, respectively of the lower roll, the outer flank surface is formed by a conical surface defining an angle $\alpha 1$ in the range of 55° to 75°, with a cylindrical reference surface centred on the centre line of the upper roll, respectively of the lower roll; and/or in the first groove of the upper roll, respectively of the lower roll, the inner flank surface is formed by a conical surface defining an angle in the range of 45° to 65°, with a cylindrical reference surface centred on the centre line of the upper roll, respectively of the lower roll. The connection between the conical inner flank surface and the substantially cylindrical bottom surface is advantageously a concavely curved transition surface.

In a preferred embodiment, the third part of the curved preform of the web has—in a cross-section—substantially the form of a letter "S" tilted by 90°, and forms a wave trough and a wave crest.

If a neutral rolling plane is defined as a plane parallel to the centre lines of the upper and lower roll of a roll pair and located at half the distance between these centre lines; and if the first flange (i.e. the flange adjacent to the first corner) has a first coupling means, preferably a hook-shaped coupling means, along its free end, then a preform of this first coupling means is advantageously rolled below the neutral rolling plane, wherein the minimum diameter of the lower roll in this region is bigger than or equal to the minimum diameter of the lower roll in its first groove. Similarly, if the second flange (i.e. the flange adjacent to the second corner) has a second coupling means, preferably a claw-shaped coupling means, along its free end, then a preform of this second coupling means is advantageously rolled above the neutral rolling plane, wherein the minimum diameter of the upper roll in this region is bigger than or equal to the minimum diameter of the upper roll in its first groove.

Before the final straightening step, the rolled preform advantageously comprises:

- a curved preform of the first flange, which has in a cross-section substantially the form of a letter "J" that is slightly tilted to the right, wherein the equivalent of the lower branch of the letter "J" is preferably equipped with first coupling means, which are preferably hook-shaped coupling means;
- a curved preform of the second flange, which has in a cross-section substantially the form of a letter "J" that is rotated clockwise by 180°, wherein the equivalent of the lower branch of the letter "J" is preferably equipped with second coupling means, which are preferably claw-shaped coupling means;
- a preform of the first corner having an opening angle $\alpha'$ greater than 90° but preferably still smaller than the first corner in the final in the Z-section sheet pile °;
- a preform of the second corner having an opening angle $\alpha'$ greater than 90° but preferably still smaller than the first corner in the final in the Z-section sheet pile °; and
- an undulated preform of the web, preferably including a substantially flat first part connected to the preform of the first corner, a central part, preferably comprising at least one wave trough and one wave crest, and preferably a substantially flat second part connected to the preform of the second corner.

The straightening of this preform then takes place between an upper straightening roll and a lower straightening roll. The lower straightening roll advantageously includes: a groove for receiving the first coupling means of the straightened sheet pile; a first conical section for entering in contact with the inner side of the first flange of the straightened sheet pile over substantially the whole width of the inner side; a second conical section for entering in contact with one side of the web of the straightened sheet pile over substantially the whole width of the web; and a third conical section for entering in contact with the outer side of the second flange of the straightened sheet pile over substantially the whole width of the outer side. The upper straightening roll advantageously includes: a first conical section for entering in contact with the outer side of the first flange of the straightened sheet pile over substantially the whole width of the outer side; a second conical section for entering in contact with the other side of the web of the straightened sheet pile over substantially the whole width of the web; a third conical section for entering in contact with the inner side of the second flange of the straightened sheet pile over substantially the whole width of the inner side; and a groove for receiving the second coupling means of the straightened sheet pile. When the preform to be straightened is introduced between the upper straightening roll and the lower straightening roll: the curved preform of the first flange preferably first rests with a convex corner portion against the first conical section of the lower straightening roll; the undulated preform of the web preferably first rests with its substantially flat first part against the second conical section of the upper straightening roll and with its substantially flat second part against the second conical section of the lower straightening roll, wherein the at least one wave trough and one wave crest are preferably arranged in the roll gap contour formed between the second conical section of the lower straightening roll and the second conical section of the upper straightening roll, without touching the latter; and the curved preform of the second flange preferably first rests with a convex corner portion against the third conical section of the upper straightening roll.

Before the rolled preform is introduced between the lower and upper straightening rolls, it is preferably rotated about a longitudinal axis by an angle in the range between 5° and 45°; preferably so that the substantially flat first part and the substantially flat second part of the undulated preform of the web are (if they exist) substantially parallel to a cone generator of the second conical section of the upper or lower straightening roll.

If a neutral rolling plane for the upper straightening roll and lower straightening roll is defined as a plane parallel to the centre lines of both straightening rolls and located at half the distance between these centre lines; then, the connections between the flange ends and the coupling means are preferably located close to the neutral rolling plane.

When the preform to be straightened is introduced between the upper straightening roll and the lower straightening roll: the convex corner portion of the curved preform of the first flange is advantageously guided along the first conical section of the lower straightening roll towards the groove receiving the first coupling means; the convex corner portion of the curved preform of the second flange is advantageously guided along the third conical section of the upper straightening roll towards the groove receiving the second coupling means; the substantially flat first part of the undulated preform of the web is advantageously guided along the second conical section of the upper straightening roll towards the first conical section of the upper straightening roll; the substantially flat second part of the undulated preform of the web is advantageously guided along the second conical section of the lower straightening roll towards the third conical section of the lower straightening roll. The at least one wave trough and the at least one wave crest are initially arranged in the roll gap contour formed between the second conical section of the lower straightening roll and the second conical section of the upper straightening roll, preferably without contacting the conical sections.

If AB is the distance in the rolled preform before straightening between the centre A of the preform of the first corner and the centre B of the preform of the preform of the second corner, and A'B' is the distance in the final sheet pile between the centre A' of the first corner and the centre B' of the second corner; then the ratio A'B'/AB is preferably in the range of 1.05 and 1.25.

BRIEF DESCRIPTION OF DRAWINGS

The afore-described and other features, aspects and advantages of the invention will be better understood with regard to the following description of an embodiment of the invention and upon reference to the attached drawings, wherein.

DETAILED DESCRIPTION OF EMBODIMENT OF THE INVENTION

Figure 5:
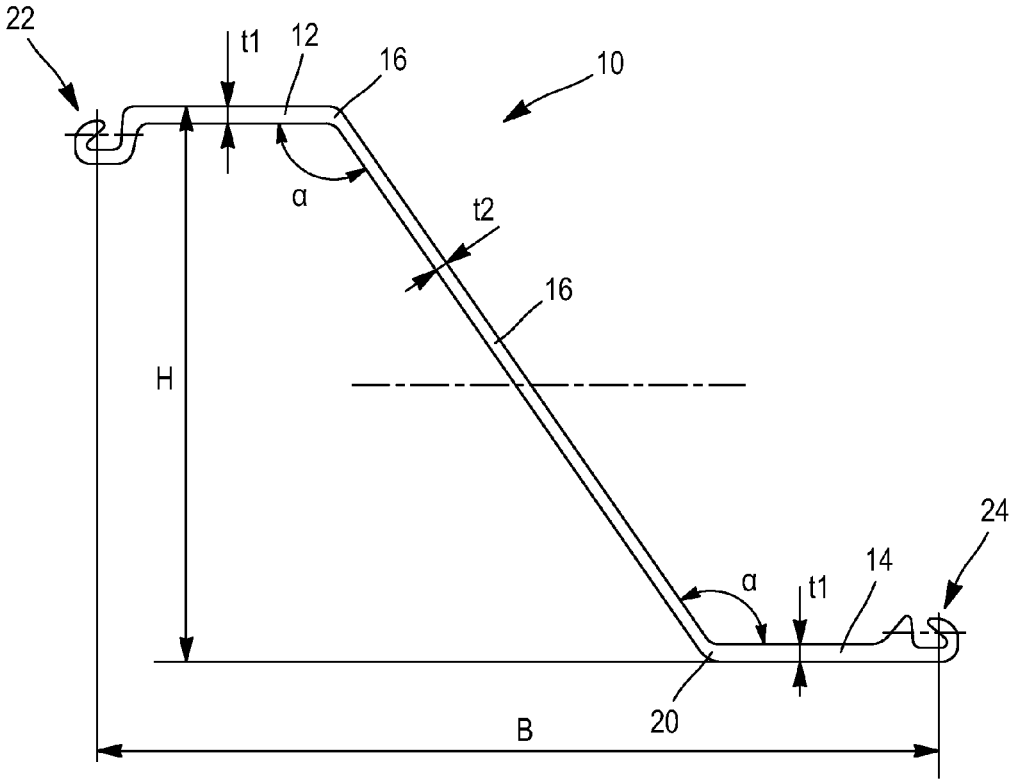
FIG. 5 is a cross-sectional view of a sheet-pile produced in accordance with the proposed method.

FIG. 5 shows a typical Z-section sheet pile 10 to be rolled with the process disclosed hereinafter. Such a typical Z-section sheet pile 10 has a first flange 12, a second flange 14, which is substantially parallel to the first flange 12, an inclined straight (i.e. flat) web 16, a first corner 18 joining the web 16 to first flange 12, a second corner 20 joining the web 16 to the second flange 14. The corners have an opening angle $\alpha$ greater than 90°, typically in the range of 110° to 140°. Z-section sheet piles presently on the market have a width B typically in the range of 500 mm to 800 mm and a height typically in the range of 250 mm to 600 mm. In most Z-section sheet piles, the web and the flanges have the same thickness (i.e. t1=t2), typically in the range of 8 mm to 20 mm. For heavier Z-section sheet piles, the thickness t1 of the flanges 12, 14 may however be greater than the thickness t2 of the web 16.

In the sheet pile 10 of FIG. 5, the first flange 12 is equipped with a hook-shaped coupling means 22, more particularly a hook-shaped LARSSEN-type coupling. The second flange 14 is equipped with a claw-shaped coupling means 24, in the present case a claw-shaped LARSSEN-type coupling. It will however be understood that the proposed method is not necessarily limited to rolling a Z-section sheet pile with LARSSEN-type coupling means 22, 24 as shown in FIG. 5. Further possible coupling means are e.g. shown in European standard EN 10248-2, but other coupling means are possible too. Furthermore, it is not excluded that the Z-section sheet pile 10 is rolled with bare flange ends or with flange ends just bearing a preform of the coupling means, wherein the coupling means is e.g. subsequently cut into the flange end or into the preform of the coupling means by one or more machining operations, or wherein the coupling means is subsequently fixed (e.g. welded) to bare flange ends.

Figure 1:
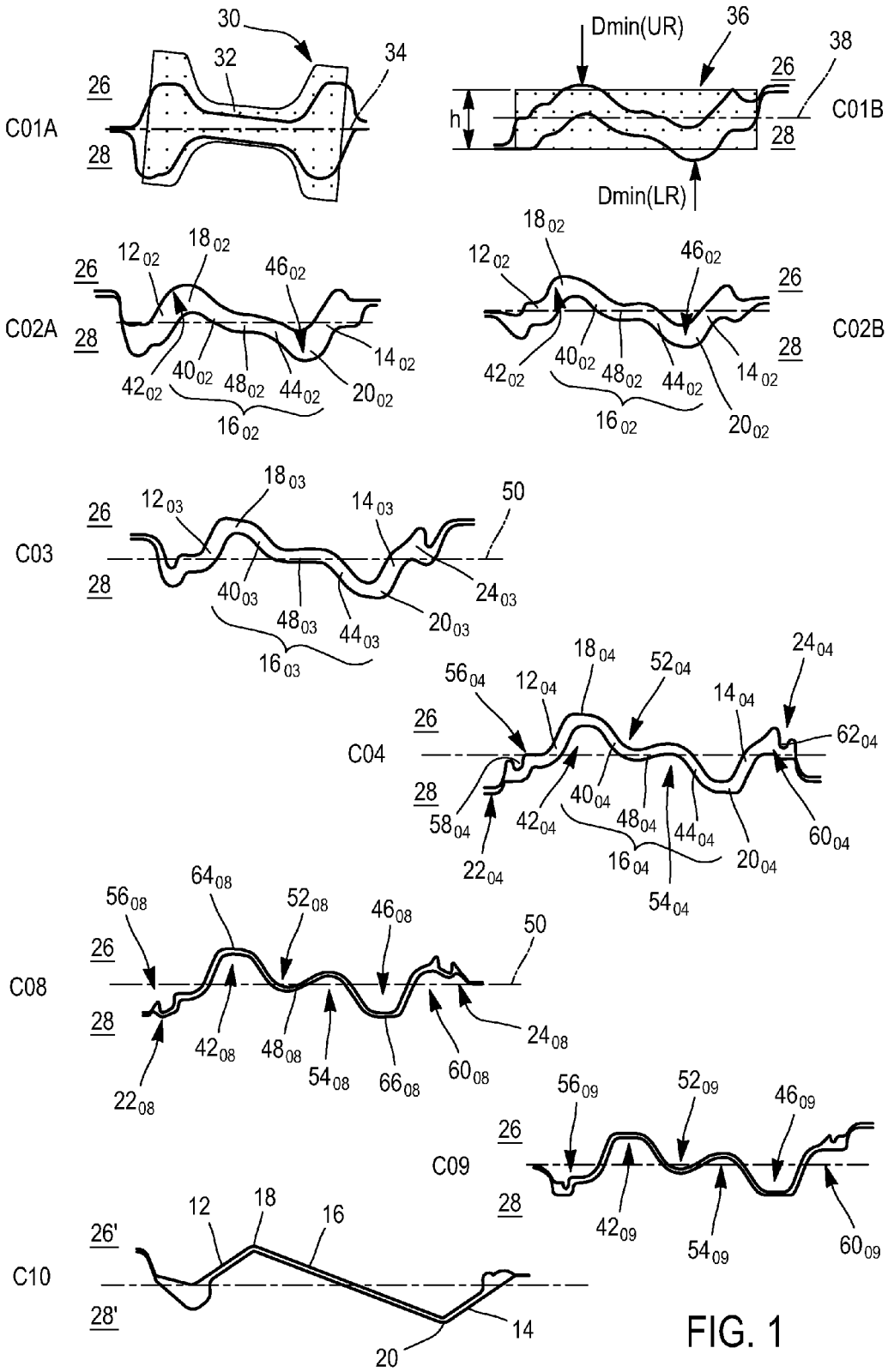
FIG. 1 schematically illustrates a method for rolling a Z-section sheet pile by vertical cross-sectional views of successive roll gaps identified with alphanumerical references C01A, C01B, C02A, C02B, C03, C04, . . . , C08, C09, C10.

FIG. 1 schematically illustrates different steps in a preferred embodiment of the proposed method for rolling such a Z-section sheet pile. The proposed method is implemented in grooved roll pairs, each roll pair comprising a grooved upper roll 26 and a grooved lower roll 28 mounted in a vertical roll stand (not shown).

The grooves in the upper roll 26 and lower roll 28 cooperate to define a roll gap with a shaped contour and, possibly, an adjustable height. In FIG. 1, each separate picture is a vertical cross-sectional view of an individually shaped roll gap contour. References C01A, C01B, C02A, C02B, C03, C04, . . . C08, C09, C10 are used to identify the successive roll gap contours used in the proposed method to roll the Z-section sheet pile 10. It will be understood that through some roll gaps, the sheet pile blank has to pass several times, wherein the height of the gap is progressively reduced by reducing the vertical distance between the upper roll 26 and the lower roll. If the sheet pile blank has to pass several times through a specific roll gap, then the roll gap contour shown in FIG. 1 shows the height of the roll gap during the last pass of the sheet pile blank through the specific roll gap. The references C01A, C01B, C02A, C02B, C03, C04, . . . C08 and C09 will also be used to identify the sheet pile blank after its final pass through a roll gap contour with the same reference.

It will further be noted that one pair of rolls 26, 28 generally defines several (most often three) adjoining roll gaps; but that several such roll pairs are nevertheless required for defining all the roll gap contours used for progressively transforming the starting product into the finished Z-section sheet pile. However, for understanding the proposed rolling method, it is not really important to know by which roll pair or in which roll stand, a particular roll gap contour C01A, C01B, C02A, C02B, C03, C04, . . . C08, C09, C10 is defined. Therefore, reference number 26 is systematically used to generally identify any upper roll, and reference number 28 is systematically used to generally identify any lower roll used in the proposed method.

It will be noted that the proposed method may be carried out with either a beam blank or a slab as a starting product. Basically, only the two first roll gap contours will differ depending on whether the starting product is a beam blank or slab. Thus, in FIG. 1, the roll gap contours C01A, C02A correspond to the case when the starting product is a beam blank, whereas the roll gap contours C01B, C02B correspond to the case when the starting product is a slab, and the roll gap contours C03 to C10 are finally common to both starting products.

In the roll gap contour C01A, the initial shape of a beam blank 30 is shown. It will be noted that this beam blank 30 is supported on a slightly inclined roll table (not shown), so that its web 32 is, at the entrance of the roll gap contour C01A, slightly inclined with regard to a horizontal plane 34. Thus, at the entrance of the roll gap contour C01A, the web part 32 of the beam blank 30 has about the same inclination as the corresponding web part in the roll gap contour C01A. As mentioned above, the roll gap height shown for the roll gap contour C01A, corresponds to the height of this roll gap during the last pass of the beam blank 30 through this roll gap contour C01A. To achieve the desired thickness reduction and deformation, three passes through the roll gap contour C01A are e.g. required, wherein the height of the roll gap is progressively decreased. At the outlet of the roll gap contour C01A, the cross-section of the sheet pile blank C0A1 still has a bone-like shape, coming close to the cross-section of the beam blank 30.

In the roll gap contour C01B, the initial shape of a slab 36 is shown. It will be noted that the horizontal plane of symmetry 38 of this slab 36 contains the so called neutral or pass line, i.e. a horizontal line located at half the vertical distance between central axis of the upper roll 26 and the central axis of the lower roll 28. To achieve the desired thickness reduction and initial deformation of the slab 36, only two to four passes through the roll gap contour C01B are required, wherein the height of the roll gap contour C01B is successively decreased. It will be noted in this context that the height (or thickness) of the slab 36, before entering for the first time into the gap contour C01B, is slightly smaller than the height of the fictive rectangle encasing the roll gap contour C01B. (As explained herein below, the height of this rectangle corresponds to [E(CC)−(Dmin(UR)+Dmin(LR))/2], wherein: E(CC) is the vertical distance between the centre lines of the upper roll 26 and the lower roll 28; Dmin(UR) is the minimum diameter of the upper roll 26; and Dmin(LR) is the minimum diameter of the lower roll 28). At the outlet of the roll gap contour C01B, the cross-section of the sheet pile blank C0B1 already has roughly the form of a tilted letter "Z".

It will be appreciated that, while the contours of the roll gaps C01A and C01B are still quite dissimilar, the contours of the subsequent roll gaps C02A and C02B are already quite similar. It follows that the cross-sections of the sheet pile blanks C02A and C02B, are already similar enough to have a common design for the next roll gap contour C03.

It will be noted that a preform of a specific part of a finished sheet pile 10 (see FIG. 5) is identified in a sheet pile blank C01A, C01B, C02A, C02B, C03, C04 . . . C08, C09, C10, with the reference of the corresponding part in FIG. 5, bearing as a subscript reference, the number of the corresponding C-reference. For example: an early preform of the web 16 in sheet pile blank C02A or C02B will be identified with the reference $\mathbf{16}_{02}$. Similarly, contour elements present in several roll gap contours or elements present in sheet pile blanks in different stages are identified with a common main reference, bearing as a subscript reference, the number of the corresponding C-reference.

In the roll gap contours C02A and C02B (and already in C01B too), a rough preform of the web 16 (see reference $\mathbf{16}_{02}$), of the first flange 12 (see reference $\mathbf{12}_{02}$), of the second flange 14 (see reference $\mathbf{14}_{02}$), of the first corner 18 (see reference $\mathbf{18}_{02}$) and of the second corner 20 (see reference $\mathbf{20}_{02}$) are rolled. The rough preform $\mathbf{18}_{02}$ of the first corner 18 and an adjoining first part $\mathbf{40}_{02}$ of the rough preform $\mathbf{16}_{02}$ of the web 16 are formed in a first groove $\mathbf{42}_{02}$ of the upper roll 26, in which this upper roll 26 has its minimum diameter. The rough preform $\mathbf{20}_{02}$ of the second corner 20 and an adjoining second part $\mathbf{44}_{02}$ of the rough preform $\mathbf{16}_{02}$ of the web 16 are formed in a first groove $\mathbf{46}_{02}$ of the lower roll 28, in which this lower roll 28 has its minimum diameter. A third part $\mathbf{48}_{02}$ of the rough preform $\mathbf{16}_{02}$ of the web 16, which is centrally located between the aforementioned first part $\mathbf{40}_{02}$ and second part $\mathbf{44}_{02}$, is formed between two cylindrical (see C02B) or two slightly conical surfaces (see C01B and C02A) of the rolls 26, 28.

In the roll gap contour C03, the thickness of all the aforementioned rough preforms $\mathbf{12}_{02}$, $\mathbf{14}_{02}$, $\mathbf{16}_{02}$, $\mathbf{18}_{02}$ and $20_{02}$ is further reduced. The aforementioned third part $48_{02}$ of the rough preform $16_{02}$ of the web 16 is widened and now rolled between two cylindrical surfaces of the rolls 26, 28 near the neutral rolling plane 50, i.e. a horizontal plane located at half the vertical distance between central axis of the upper roll 26 and the central axis of the lower roll 28. It follows that the third part $48_{03}$ of the rough preform $16_{03}$ of the web 16 of the sheet pile blank C03 is substantially flat. Furthermore, a rough preform $22_{03}$ of the hook-shaped coupling means 22 is rolled into the end part of the early preform $12_{02}$ of the first flange 12, and a rough preform $24_{03}$ of the claw-shaped coupling means 24 is rolled into the end part of the rough preform $14_{02}$ of the second flange 12.

In the roll gap contour C04, the thickness of all the preforms $12_{03}$, $14_{03}$, $16_{03}$, $18_{03}$ and $20_{03}$ rolled with the roll gap contour C03 is further reduced. Furthermore, the substantially flat and horizontal third part $48_{03}$ of the early preform $16_{03}$ of the web 16 is now rolled as a slightly undulated third part $48_{04}$, which has—in a cross-section—substantially the form of a letter "S" tilted by 90°. This undulated third or central part $48_{04}$ of the preform $16_{04}$ of the web 16 is formed partly in a second groove $52_{04}$ of the lower roll 28, which is horizontally adjacent to the first groove $42_{04}$ in the upper roll 26, and partly in a second groove $54_{04}$ of the upper roll 26, which is horizontally adjacent to the second groove $52_{04}$ in the lower roll 28. The rough preform $22_{03}$ of the hook-shaped coupling means 22 is further elaborated in a third groove $56_{04}$ in the lower roll 28, located slightly below the rolling plane 50, by means of a first ring-shaped bead $58_{04}$ of the upper roll 26. The rough preform $24_{03}$ of the claw-shaped coupling means 24 is further elaborated in a third groove $60_{04}$ in the upper roll 26, located slightly above the rolling plane 50, wherein the upper roll 26 has a second ring-shaped bead $62_{04}$ located in the third groove $60_{04}$ for shaping an internal chamber in the preform $24_{04}$ of the claw-shaped coupling means 24.

In the roll gap contours C05 to C07, which are not shown in FIG. 1, the thickness of all the preforms $12_{04}$, $14_{04}$, $16_{04}$, $18_{04}$ and $20_{04}$ rolled with the roll gap contour C04 is still further reduced. Comparing roll gap contour C04 to roll gap contour C08, it will be appreciated that the increase in length of the curved preform $16_{04}$ of the web 16, which is caused by a thickness reduction, is absorbed partially by developing a substantially flat part $64_{08}$ in the first groove $42_{08}$ of the upper roll 26 and a substantially flat part $66_{08}$ in the first groove $46_{04}$ of the lower roll 28, and partially by an increased depth of the second groove $52_{08}$ of the lower roll 28 and of the second groove $54_{08}$ of the upper roll 28. The increase in length of the preform $12_{04}$ of the first flange 12, which is caused by the thickness reduction, is mainly absorbed by arranging the equivalent $56_{08}$ of the third groove $56_{04}$, in which a preform $22_{08}$ of the hook-shaped coupling means 22 is formed, at a greater distance below the rolling plane 50. The minimum diameter of the lower roll 28 in the third groove $56_{08}$, remains however greater than (or at least equal to) the minimum diameter of the lower roll 28 in the first groove $46_{08}$. Similarly, the increase in length of the preform $14_{04}$ of the second flange 14, which is caused by the thickness reduction, is mainly absorbed by arranging the equivalent $60_{08}$ of the third groove $60_{04}$, in which a preform $24_{08}$ of the claw-shaped coupling means 24 is formed, at a greater distance above the rolling plane 50. The minimum diameter of the upper roll 26 in the third groove $60_{08}$, remains however greater than (or at least equal to) the minimum diameter of the upper roll 26 in the first groove $42_{08}$.

The roll gap contour C09 differs from the roll gap contour C08 mainly in the third groove $56_{09}$ in the lower roll 28, in which the hook-shaped coupling means 22 is finished, and in the in the third groove $60_{09}$ in the upper roll 26, in which the claw-shaped coupling means 24 is finished. The first and second groove $46_{09}$, $52_{09}$ in the lower roll 28, and the first and second groove $42_{09}$, $54_{09}$ in the upper roll 26 are substantially equal in the roll gap contours C08 and C09. The sheet pile blank C09 has a curved preform $16_{09}$ of the web 16, a curved preform $12_{09}$ of the first flange 12, equipped with the hook-shaped coupling means 22, and a curved preform $14_{09}$ of the second flange 14, equipped with the claw-shaped coupling means 24. The geometry of the roll gap contour C09 and the sheet pile blank C09 will be described in greater detail hereinafter with reference to FIG. 2.

Figure 2:
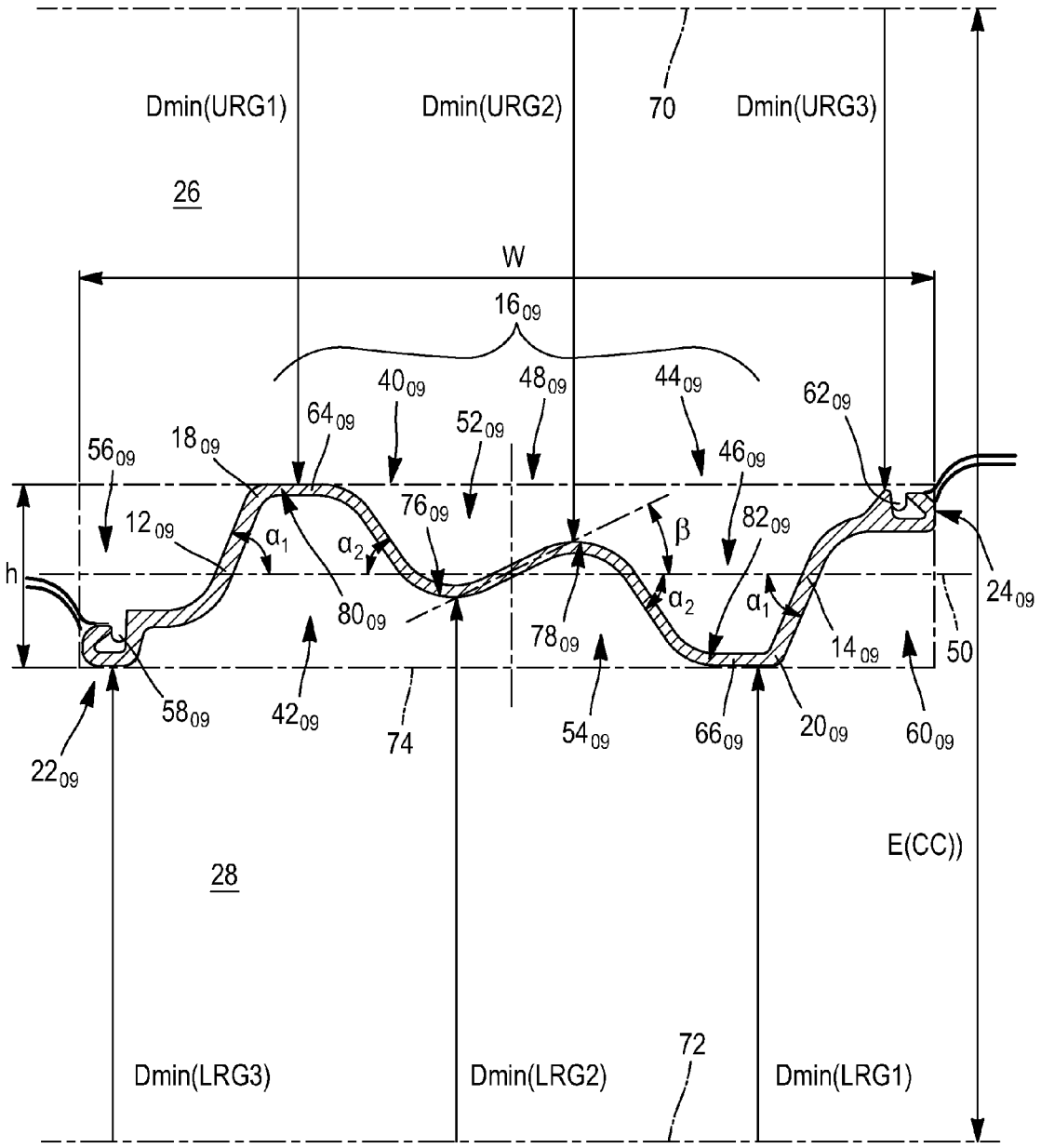
FIG. 2 is a schematic vertical cross-sectional view of the roll gap C09 of FIG. 1, further showing the centre lines of an upper and lower roll and, within the roll gap C09, a final sheet pile blank C09 rolled in this roll gap.

The roll gap contour C10 is conceived as a pure straightening roll gap, in which the curved preform $16_{09}$ of the web 16, the curved preform $12_{09}$ of the first flange 12, and the curved preform $14_{09}$ of the second flange 14 are straightened, thereby conferring the final geometry of a Z-section sheet pile 10, as shown in FIG. 5, to the sheet pile blank C09 as shown in FIG. 2.

Referring now to FIG. 2, the geometry of the roll gap contour C09 and the sheet pile blank C09 will be described in greater detail. Reference number 70 identifies the centre line of the upper roll 26, and reference number 72 the centre line of the lower roll 28. The centre line 70, 72 of a roll is defined as being the line about which the roll 26, 28 rotates, i.e. the line passing through the centres of the two bearing journals of the roll. The vertical distance between the two centre lines 70, 72 is indicated with arrow E(CC). The nominal diameter Dnom of the upper roll 26 and the lower roll 28 equals by definition the distance E(CC). (In order to save space, roll diameters are identified in FIG. 2 by arrows starting only at the centre line 70, 72 of the roll 26, 28.)

Looking at FIG. 2, one notices that the sheet pile plank C09 is rolled in six grooves, defined in the upper roll 26 and the lower roll 28, i.e.:

1) the first groove $42_{09}$ in the upper roll 26: in which the preform $18_{09}$ of the first corner 18 and the adjoining first part $40_{09}$ of the curved preform $16_{09}$ of the web 16 are rolled; in which the upper roll 26 has a minimum diameter Dmin(URG1), smaller than Dnom; and in which the lower roll 28 has a convex shape mating the concave shape of the first groove $42_{09}$ in the upper roll 26;
2) the first groove $46_{09}$ in the lower roll 28: in which the preform $20_{09}$ of the second corner 20 and the adjoining second part $44_{09}$ of the curved preform $16_{09}$ of the web 16 are rolled; in which the lower roll 28 has a minimum diameter Dmin(LRG1), smaller than Dnom; and in which the upper roll 26 has a convex shape mating the concave shape of the first groove $46_{09}$ in the lower roll 28;
3) the second groove $52_{09}$ in the lower roll 28: which is horizontally adjacent to the first groove $42_{09}$ in the upper roll 26; in which a first curved part (i.e. a wave trough) of the third part $48_{09}$ of the curved preform $16_{09}$ of the web 16 is rolled; in which the lower roll 28 has a minimum diameter Dmin(LRG2), slightly smaller than Dnom; and in which the upper roll 26 has a convex shape mating the concave shape of the second groove $52_{09}$ in the lower roll 28;
4) the second groove $54_{09}$ in the upper roll 26: which is horizontally adjacent to the first groove $46_{09}$ in the lower roll 26; in which a second curved part (i.e. a wave trough) of the third part $48_{09}$ of the curved preform $16_{09}$ of the web 16 is rolled; in which the upper roll 26 has a minimum diameter Dmin(URG2), slightly smaller than Dnom; and in which the lower roll 28 has a convex shape mating the concave shape of the second groove $\mathbf{54}_{09}$ in the upper roll 26;

5) the third groove $\mathbf{56}_{09}$ in the lower roll 28: which is horizontally adjacent to the first groove $\mathbf{42}_{09}$ in the upper roll 26; in which the hook-shaped coupling means 22 is rolled; in which the lower roll 28 has a minimum diameter Dmin(LRG3), smaller than Dnom; and in which the upper roll 26 has a mating convex shape with a first ring-shaped bead $\mathbf{58}_{09}$ penetrating into a ring-shaped cavity in the third groove $\mathbf{56}_{09}$, to form therein the hook-shaped coupling means 22; and 6) the third groove $\mathbf{60}_{09}$ in the upper roll 26: which is horizontally adjacent to the first groove $\mathbf{46}_{09}$ in the lower roll 26; in which the claw-shaped coupling means 24 is rolled; in which the upper roll 26 has a minimum diameter Dmin(URG3), smaller than Dnom; in which the upper roll 26 has a ring-shaped depression with a second ring-shaped bead $\mathbf{62}_{09}$ therein, to form therein the claw-shaped coupling means 24; and in which the lower roll 26 has a mating convex shape to form the substantially flat back of the claw-shaped coupling means 24.

From the left to the right, the succession of the six grooves forming the roll gap contour C09 is as follows: (1) the third groove $\mathbf{56}_{09}$ in the lower roll 28; (2) the first groove $\mathbf{42}_{09}$ in the upper roll 26; (3) the second groove $\mathbf{52}_{09}$ in the lower roll 28; (4) the second groove $\mathbf{54}_{09}$ in the upper roll 26; (5) the first groove $\mathbf{46}_{09}$ in the lower roll 28; and (6) the third groove $\mathbf{60}_{09}$ in the upper roll 26.

It will further be noted that: Dmin(LRG1) is about equal to Dmin(URG1); Dmin(LRG2) is bigger than Dmin(LRG1); and Dmin(LRG3) is about equal to Dmin(LRG1). Similarly: Dmin(URG2) is bigger than Dmin(URG1); and Dmin (URG3) is about equal to Dmin(URG1).

This layout of the proposed roll gap contour is further illustrated by reference to a rectangle 74, which is drawn in FIG. 2 with a dash-dot-line. The width w of this rectangle 74 is the overall horizontal width of the roll gap contour, and the height h is the overall vertical height of the roll gap contour, i.e.:

$$h = E\min(CC) - [D\min(\mathrm{URG1}) - D\min(\mathrm{LRG1})]/2.$$

wherein Emin(CC) is the minimal vertical distance between the centre lines of the upper roll 26 and the lower roll 28, i.e. when the upper roll 26 and the lower roll 28 are closest (in case the sheet pile blank passes several times through the roll gap contour and the height of the roll gap contour is reduced between the successive passes). The neutral rolling plane 50 is the centre plane of the rectangle 74.

The shape of this rectangle 74 may be characterized by its width-to-height-ratio w/h. In the example shown in FIG. 2, this ratio is about 5. With the method disclosed in U.S. Pat. No. 5,671,630 the same ratio is less than 3, which means that with the prior art method, the grooves in the rolls are—for the same available rolling width—much deeper than with the new method proposed herein.

It will be appreciated that—due the use of a roll gap contour with a total of six adjacent grooves $\mathbf{56}_{09}$, $\mathbf{42}_{09}$, $\mathbf{52}_{09}$, $\mathbf{54}_{09}$, $\mathbf{46}_{09}$, $\mathbf{60}_{09}$—the individual parts of the sheet pile blank C09 (as well as those of any one of the sheet pile blanks C04 to C08) can be rolled in the direct vicinity of the neutral rolling plane 50, i.e. without requiring deep grooves in the rolls 26, 28. It follows that the initial minimum diameter of the rolls 26, 28 can be bigger; i.e. the roll gap contour can be reworked more often, before the minimum diameters of the rolls decrease beyond a limit value. When compared to the method disclosed in U.S. Pat. No. 5,671,630, the method proposed herein allows gaining about 80 mm on the minimum diameter of the rolls. Furthermore, less deep grooves in the rolls also result in smaller rolling torques and in more equal surface speeds along the roll gap contour, i.e. in less mechanical wear of the surfaces of the rolls. Finally, grooves with generously rounded corners, as in the proposed roll gap contours, also result in smaller stresses in the rolls. In summary, with the proposed method, the rolls wear out less faster and must be reworked less often, but—due to a bigger minimum diameter—can even be reworked more often than with any prior art method for rolling Z-section sheet piles. Consequently, with the proposed method, total life-time of the rolls is substantially increased.

It will further be appreciated that—due to the six adjacent grooves 56, 42, 52, 54, 46, 60—the sheet pile blank is very well guided between the rolls, which facilitates, amongst others, rolling of the coupling means (the sheet pile blank is less likely to deviate laterally).

Another significant advantage of the proposed method is that it is possible to roll the Z-section sheet pile starting with a relatively thin slab.

To facilitate straightening of the curved preform $\mathbf{16}_{09}$ of the web 16, the depth of the second groove $\mathbf{52}_{09}$ in the lower roll 28 and the depth of the second groove $\mathbf{54}_{09}$ in the upper roll 26 are preferably less important the depth of the first groove $\mathbf{46}_{09}$ in the lower roll 28 and the depth of the first groove $\mathbf{42}_{09}$ in the upper roll 26. In the example illustrated by the drawings one has e.g.:

$$[D\mathrm{nom} - D\min(\mathrm{URG2})] < 0.2 \cdot [D\mathrm{nom} - D\min(\mathrm{URG1})]$$

and $$[D\mathrm{nom} - D\min(\mathrm{LRG2})] < 0.2 \cdot [D\mathrm{nom} - D\min(\mathrm{LRG1})].$$

As can be seen in FIG. 2, the second groove $\mathbf{52}_{09}$ in the lower roll 28 and the second groove $\mathbf{54}_{09}$ in the upper roll 26 have a concavely curved bottom surface 76, 78, whereas the bottom surfaces in the first groove $\mathbf{46}_{09}$ in the lower roll 28 and the first groove $\mathbf{42}_{09}$ in the upper roll 26 are substantially cylindrical surfaces, at least in the direct neighborhood of the corners rolling the preforms $\mathbf{18}_{09}$, $\mathbf{20}_{09}$ of the corners 18, 20.

In the first groove $\mathbf{46}_{09}$ of the upper roll 26, the outer flank surface is formed by a conical surface defining an angle $\alpha 1$ of about 67°, and the inner flank surface is formed by a conical surface defining an angle $\alpha 2$ of about 55°, with a cylindrical reference surface centred on the centre line 70 of the upper roll 26. Similarly, in the first groove $\mathbf{46}_{09}$ of the lower roll 28, the outer flank surface is formed by a conical surface defining an angle $\alpha 1$ of about 67°, and the inner flank surface is formed by a conical surface defining an angle $\alpha 2$ of about 55°, with a cylindrical reference surface centred on the centre line 72 of the lower roll 26. Typically, $\alpha 1$ is in the range of 55° to 75°, preferably 60° to 70°, and $\alpha 2$ is in the range of 45° to 65°, preferably 50° to 60°.

The third part $\mathbf{48}_{09}$ of the curved preform $\mathbf{16}_{09}$ of the web 16 has substantially the form of a letter "S" tilted by 90°, forming a wave trough and a wave crest. The central part of the "S"-shaped part, which joins the wave trough to the wave crest, makes an angle $\beta$ of about 25° (typically $\beta$ is in the range of 10° to 40°, preferably 20° to 30°).

The preform $\mathbf{12}_{09}$ of the first flange 12 has substantially the form of a letter "J" that is slightly tilted to the right, wherein the equivalent of the lower branch of the letter "J", which is equipped with the preform $\mathbf{22}_{09}$ of the hook-shaped coupling means 22, extends substantially parallel to the neutral plane 50. The preform $\mathbf{14}_{09}$ of the second flange 14 has substantially the form of a letter "J" that is rotated clockwise by about 180°, wherein the equivalent of the lower branch of the letter "J", which is equipped with the preform $\mathbf{24}_{09}$ of the claw-shaped coupling means 24, extends substantially parallel to the neutral plane 50. As already stated above, the preform $\mathbf{22}_{09}$ of the hook-shaped coupling means 22 is rolled below the neutral rolling plane 50, wherein Dmin(LRG3) is substantially equal to Dmin (LRG1); and the preform $\mathbf{24}_{09}$ of the claw-shaped coupling means 24 is rolled above the neutral rolling plane 50, wherein Dmin(URG3) is substantially equal to Dmin (URG1). It will also be noted that the preform $\mathbf{22}_{09}$ has already the final shape of the hook-shaped coupling means 22, and the preform $\mathbf{24}_{09}$ has already the final shape of the claw-shaped coupling means 24. However, due to the curved preform $\mathbf{12}_{09}$ and $\mathbf{14}_{09}$ of the flanges 12 and 14, the orientation of the coupling means 22, 24 is not yet final.

Figure 6:
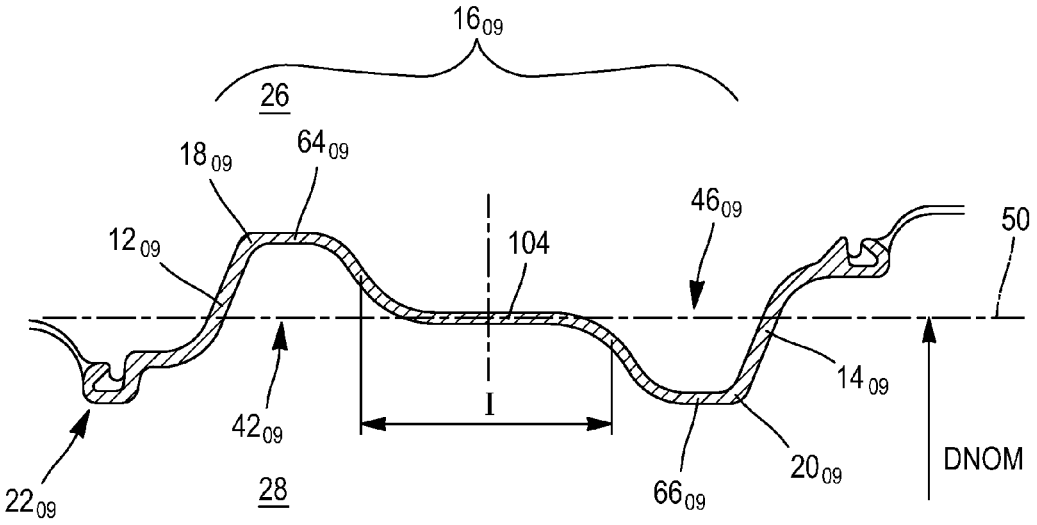
FIG. 6 is a schematic vertical cross-sectional view of another embodiment of the last roll gap rolling another sheet pile blank to be straightened thereafter.

Another embodiment of a roll gap and a sheet pile blank in accordance with the present invention is shown in FIG. 6. This embodiment distinguishes over the embodiment of FIG. 2 in that in the interval "I" between the first groove $\mathbf{42}_{09}$ in the upper roll 26 and the first groove $\mathbf{46}_{09}$ in the lower roll 28, the diameter of the lower roll 28 first decreases until it is about equal to the nominal diameter Dnom, then stays constant over a certain length of the lower roll 28, before it decreases again. The diameter of the upper roll 26 varies in a complementary manner in this interval I. This means that the middle section 104 of the curved preform of the web $\mathbf{16}_{09}$ is mainly formed between a substantially cylindrical portion of the upper roll 26 and a substantially cylindrical portion the lower roll 28, close to the neutral rolling plane. Due to the fact that the middle section 104 of the curved preform of the web $\mathbf{16}_{09}$ is rolled—at least partly—between substantially cylindrical roll sections, less vertical space is required for rolling the preform of the web; i.e. the minimum diameters of the two rolls may be bigger than with any prior art method of rolling Z-shaped sheet-piles. It will be noted that instead of rolling, as shown in FIG. 6, one intermediate step into the curved preform of the web $\mathbf{16}_{09}$, one may also roll several intermediate steps into the curved preform of the web $\mathbf{16}_{09}$.

Figure 3:
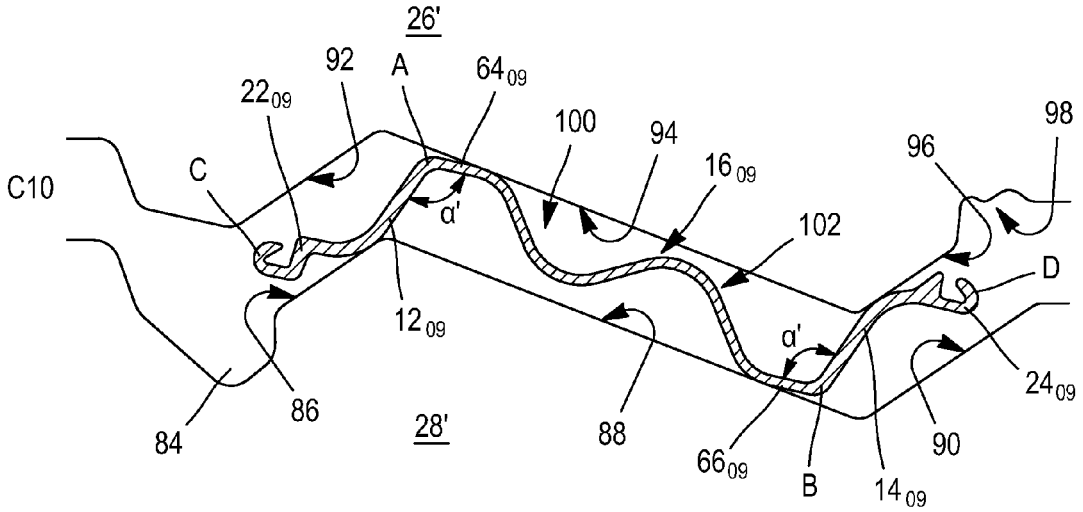
FIG. 3 is a schematic vertical cross-sectional view of the roll gap C10 of FIG. 1, at the entrance of a roll gap defined by an upper and lower straightening roll, i.e. the vertical section plane is out of alignment with the centre lines of the upper and lower straightening roll; the section further showing the final sheet pile blank C09 of FIG. 2, as it enters into first contact with the straightening rolls.
Figure 4:
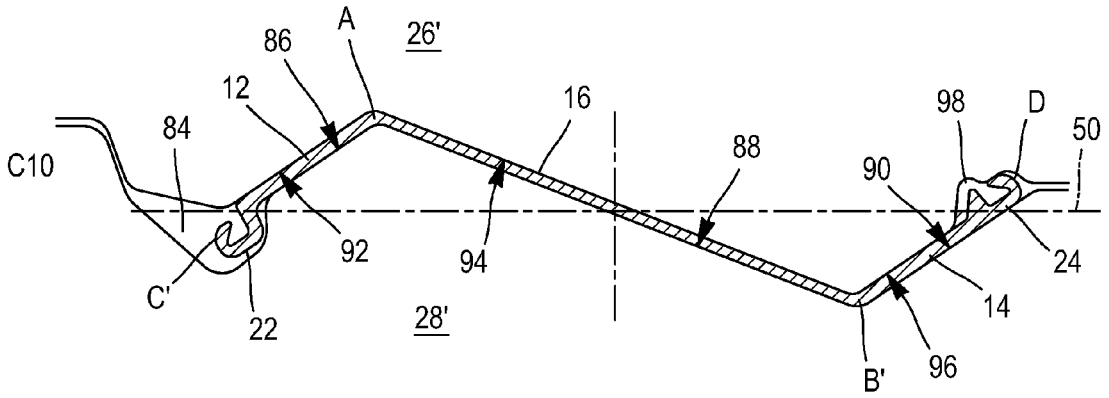
FIG. 4 is a schematic vertical cross-sectional view as in FIG. 3, the vertical section plane now containing the centre lines of the upper and lower straightening roll.

The straightening of the sheet pile blank C09 is now described with reference to FIG. 3 and FIG. 4. In FIG. 3 one recognizes the sheet pile blank C09 described with reference to FIG. 2 at the inlet of a roll gap defined by an upper straightening roll 26' and a lower straightening roll 28' (the vertical section plane is out of alignment with the centre lines of the upper and lower straightening roll 26', 28'), wherein the sheet pile blank is shown in a position when it enters into first contact with the straightening rolls 26', 28'. In FIG. 4, the finished Z-section sheet pile 10 is shown at the outlet of the roll gap defined by the upper straightening roll 26' and the lower straightening roll 28' (in this FIG. 4, the vertical section plane contains the centre lines of the upper and lower straightening roll 26', 28').

The lower straightening roll 28' includes (see FIGS. 3 and 4): a groove 84 for receiving the first coupling means 22 of the straightened sheet pile; a first conical section 86, which in FIG. 4 is in contact with the inner side of the first flange 12 of the straightened sheet pile over substantially the whole width of this inner side; a second conical section 88, which in FIG. 4 is in contact with one side of the web 16 of the straightened sheet pile over substantially the whole width of this web 16; and a third conical section 90, which in FIG. 4 is in contact with the outer side of the second flange 14 of the straightened sheet pile over substantially the whole width of this outer side.

The upper straightening roll 26' includes: a first conical section 92, which in FIG. 4 is in contact with the outer side of the first flange 12 of the straightened sheet pile over substantially the whole width of this outer side; a second conical section 94, which in FIG. 4 is in contact with the other side of the web of the straightened sheet pile over substantially the whole width of the web 16; a third conical section 96, which in FIG. 4 is in contact with the inner side of the second flange 14 of the straightened sheet pile over substantially the whole width of this inner side; and a groove 98 for receiving the second coupling means 24 of the straightened sheet pile.

It will consequently be noted that the geometry of the upper straightening roll 26' and the lower straightening roll 28' is mainly determined by the geometry of the final Z-section sheet pile 10.

Before the sheet pile blank C09 is introduced between the upper straightening roll 26' and the lower straightening roll 28', it is rotated about a longitudinal axis so that the substantially flat first parts $\mathbf{64}_{09}$ and $\mathbf{66}_{09}$ of the undulated preform $\mathbf{16}_{09}$ of the web 16 are substantially parallel to a cone generator of the second conical section 94 of the upper straightening roll 26', respectively to a cone generator of the second conical section 88 of the lower straightening roll 28'. In the present case the sheet pile blank has e.g. been rotated by an angle of about 12° about a longitudinal axis passing through the convex corner defined by the J-shaped preform $\mathbf{12}_{09}$ of the first flange 12.

In FIG. 3, the sheet pile blank C09 is shown within the roll gap C10 in first contact with the straightening rolls 26', 28'; i.e. before start of the straightening. The curved preform $\mathbf{12}_{09}$ of the first flange 12 rests with a convex corner portion against the first conical section 86 of the lower straightening roll 28'. The undulated preform $\mathbf{16}_{09}$ of the web 16 rests with its substantially flat second part $\mathbf{66}_{09}$ against the second conical section 88 of the lower straightening roll 28'. The upper straightening roll 26' contacts the sheet pile blank C09 with its second conical section 94 at the substantially flat first part $\mathbf{64}_{09}$ of the undulated preform $\mathbf{16}_{09}$ of the web 16, and with its third conical section 96 at a convex corner portion of the curved preform $\mathbf{14}_{09}$ of the second flange 14. It will be noted that a wave trough 100 and a wave crest 102 of the undulated preform $\mathbf{16}_{09}$ of the web 16 are arranged in the roll gap contour formed between second conical section 88 of the lower straightening roll 28' and the second conical section 94 of the upper straightening roll 26', without touching the latter. This is possible because, as described above, in the roll gap contour C09, the depth of the second groove $\mathbf{52}_{09}$ in the lower roll 28 and the depth of the second groove $\mathbf{54}_{09}$ in the upper roll 26 are by far less important than the depth of the first groove $\mathbf{46}_{09}$ in the lower roll 28 and the depth of the first groove $\mathbf{42}_{09}$ in the upper roll 26. It will be appreciated that the fact that—at least during the initial straightening of the undulated web $\mathbf{16}_{09}$—the wave trough 100 and the wave crest 102 do not touch the straightening rolls 26', 28' greatly facilitates this straightening operation.

The straightening of the sheet pile blank C10 in the roll gap contour C10 may be performed in just one pass. During the straightening, the convex corner portion of the curved preform $\mathbf{12}_{09}$ of the first flange 12 is guided along the conical section 86 of the lower straightening roll 28' towards the groove 84 receiving the first coupling means $\mathbf{22}_{09}$. Similarly, the convex corner portion of the curved preform $\mathbf{14}_{09}$ of the second flange 14 is guided along the third conical section 96 of the upper straightening roll 26' towards the groove 98 receiving the second coupling means $\mathbf{24}_{09}$. Simultaneously, the opening angles α' of the preforms $\mathbf{18}_{09}$, $\mathbf{20}_{09}$ of the first and second corners 18, 20, which are initially greater than 90° but still smaller than the corresponding opening angles in the Z-section sheet pile, increase. The substantially flat first part $\mathbf{64}_{09}$ of the undulated preform $\mathbf{16}_{09}$ of the web 16 is guided along the second conical section 94 of the upper straightening roll 26' towards the conical section 92 of the upper straightening roll 26'. Similarly, the substantially flat second part $\mathbf{66}_{09}$ of the undulated preform $\mathbf{16}_{09}$ of the web 16 is guided along the second conical section 88 of the lower straightening roll 88 towards the third conical section of lower upper straightening roll 28'.

FIG. 3 shows the straightened Z-shaped sheet coming out of the roll gap defined by the straightening rolls 26', 28'. The web 16, the first flange 12 and the second flange 14 are now flat and the coupling means 22, 24, which are located in the grooves 84, 98, have their final orientation with regard to the first flange 12 and the second flange 14. The connections between the flange ends and the coupling means 22, 24 are located close to said neutral rolling plane 50.

During the straightening of the preform $\mathbf{16}_{09}$ of the web 16, the distance between the points A and B, which are the centres of the corners 18, 20, increases by about 14%. Similarly, the distance between the points C and D on the external end faces of the coupling means increases by about 12%. Finally, the ratio between the overall horizontal width w of the roll gap contours C10 and C09 is about 1.2.

It will be appreciated that the proposed method is particularly advantageous for rolling Z-section sheet piles in which the thickness t2 of the web 16 is smaller than the thickness t1 of the flanges 12, 14 and/or in which the corners 18, 20 are externally and/or internally reinforced by a local extra-thickness of the web 16 and/or the flange 12, 14.

Reference signs list
(In the list below, "i" stands for a subscript formed on the basis of the reference used for identifying the roll gap contour or the preform of the sheet pile rolled in this roll gap contour)

| | |
|---|---|
| 10 | Z-section sheet pile |
| 12 | first flange |
| $12_i$ | preform of 12 |
| 14 | second flange |
| $14_i$ | preform of 14 |
| 16 | inclined straight web |
| $16_i$ | preform of 16 |
| 18 | first corner |
| $18_i$ | preform of 18 |
| 20 | second corner 20 |
| $20_i$ | preform of 20 |
| 22 | hook-shaped coupling means |
| $22_i$ | preform of 22 |
| 24 | claw-shaped coupling means |
| $24_i$ | preform of 24 |
| 26 | upper roll |
| 26' | upper straightening roll |
| 28 | lower roll |
| 28' | lower straightening roll |
| 30 | beam blank |
| 32 | web of 30 |
| 34 | horizontal plane |
| 36 | slab |
| 38 | horizontal plane of symmetry of 36 |
| $40_i$ | first part of 16 adjoining 18 |
| $42_i$ | first groove of 26 |
| $44_i$ | second part of 16 adjoining 20 |
| $46_i$ | first groove of 28 |
| $48_i$ | third part of 16 |
| 50 | neutral rolling plane |

-continued

Reference signs list
(In the list below, "i" stands for a subscript formed on the basis of the reference used for identifying the roll gap contour or the preform of the sheet pile rolled in this roll gap contour)

| | |
|---|---|
| $52_i$ | second groove in 28 |
| $54_i$ | second groove in 26 |
| $56_i$ | third groove in 28 |
| $58_i$ | first ring-shaped bead of 26 |
| $60_i$ | third groove in 26 |
| $62_i$ | second ring-shaped bead of 26 |
| $64_i$ | substantially flat part of $40_i$ |
| $66_i$ | substantially flat part of $44_i$ |
| 70 | centre line of 26 |
| 72 | centre line of 28 |
| 74 | rectangle in FIG. 2 |
| $76_i$ | bottom surface in $52_i$ |
| $78_i$ | bottom surface in $54_i$ |
| $80_i$ | bottom surface in $42_i$ |
| $82_i$ | bottom surface in $46_i$ |
| 84 | a groove in 28' for 22 |
| 86 | first conical section of 28' |
| 88 | second conical section of 28' |
| 90 | third conical section of 28' |
| 92 | first conical section of 26' |
| 94 | second conical section of 26' |
| 96 | third conical section of 26' |
| 98 | a groove in 26' for 24 |
| 100 | wave trough |
| 102 | wave crest |
| 104 | middle section of the curved preform of the web |

The invention claimed is:

1. A method for rolling a Z-section sheet pile having a first flange, a second flange, which is substantially parallel to said first flange, an inclined web, a first corner joining said web to said first flange, a second corner joining said web to said second flange, wherein each of said corners has an opening angle a greater than 90°;

wherein said method comprises the steps of:

rolling a precursor of said Z-section sheet pile with a curved precursor of said web in successive roll gaps defined by at least one roll pair comprising a grooved upper roll and a grooved lower roll, wherein:

a precursor of the first corner and an adjoining first part of said curved precursor of said web are formed in a first groove of said upper roll, and a precursor of the second corner and an adjoining second part of said curved precursor of said web are formed in a first groove of said lower roll; and subsequently straightening said curved precursor of said web by introducing said precursor of said Z-section sheet pile between an upper straightening roll and a lower straightening roll;

wherein:

at least in the roll gaps that finish forming said curved precursor of said web, said lower roll has a diameter that decreases in a discontinuous manner in an interval between said first groove in said upper roll and said first groove in said lower roll, and said upper roll has a diameter that increases in said interval in a complementary manner.

2. The method as claimed in claim 1, wherein, during the step of rolling a precursor of said Z-section sheet pile:

a third part of said curved precursor of said web, which is located between said first part and said second part of said curved precursor of said web, is formed either partly in at least a second groove of said lower roll and partly in at least a second groove of said upper roll, or partly between substantially cylindrical portions of said upper roll and said lower roll.

3. The method as claimed in claim 2, wherein for said at least one roll pair:

said upper roll has a center line that is defined as being an axis about which said upper roll rotates;

said lower roll has a center line that is defined as being an axis about which said lower roll rotates;

said center line of said upper roll and said center line of said lower roll are separated by a minimum vertical distance;

a nominal diameter of the upper roll and the lower roll is defined as being said minimum vertical distance;

said lower roll has a minimum diameter in its first groove and a minimum diameter in its second groove;

the minimum diameter of said lower roll in its second groove is smaller than said nominal diameter and bigger than its minimum diameter in its first groove;

and/or said upper roll has a minimum diameter in its first groove and a minimum diameter in its second groove;

the minimum diameter of said upper roll in its second groove is smaller than said nominal diameter and bigger than its minimum diameter in its first groove.

4. The method as claimed in claim 3, wherein if:

Dmin(URG1) is the minimum diameter of said upper roll in its first groove;

Dmin(URG2) is the minimum diameter of said upper roll in its second groove;

Dmin(LRG1) is the minimum diameter of said lower roll in its first groove; and

Dmin(LRG2) is the minimum diameter of said lower roll in its second groove; and

Dnom is the nominal diameter of the upper roll and of the lower roll;

then:

$$[D\text{nom}-D\text{min}(\text{URG2})]<k\cdot[D\text{nom}-D\text{min}(\text{URG1})]$$

and/or $$[D\text{nom}-D\text{min}(\text{LRG2})]<k\cdot[D\text{nom}-D\text{min}(\text{LRG1})]$$

wherein k is smaller than 1.

5. The method as claimed in claim 4, wherein k is smaller than 0.5.

6. The method as claimed in claim 4, wherein k is smaller than 0.2.

7. The method as claimed in claim 2, wherein:

in a cross-section, said third part of said curved precursor of said web has substantially the form of a letter "S" tilted by 90°, forming a wave trough (100) and a wave crest (102).

8. The method as claimed in claim 2, wherein:

in said second groove of said upper roll and/or lower roll, the bottom surface is formed by a concavely curved surface.

9. The method as claimed in claim 1, wherein in at least one of said roll gaps in which said precursor of said Z-section sheet pile with a curved precursor of said web is rolled:

said upper roll has a minimum diameter Dmin(URG1) in its first groove and a center line that is defined as being an axis about which said upper roll rotates;

said lower roll has a minimum diameter Dmin(LRG1) in its first groove and a center line that is defined as being an axis about which said lower roll rotates;

said center line of said upper roll and said center line of said lower roll are separated by a minimum vertical distance E(CC);

said roll gap has a width w;

wherein:

$$\{w/[E(\text{CC})-(D\text{min}(\text{UR})+D\text{min}(\text{LR}))/2]\}>3.5.$$

10. The method as claimed in claim 9, wherein:

$$\{w/[E(\text{CC})-(D\text{min}(\text{UR})+D\text{min}(\text{LR}))/2\ ]\}>4.$$

11. The method as claimed in claim 1, wherein:

in said first groove of said upper roll and/or lower roll, a bottom surface is formed by a substantially cylindrical surface.

12. The method as claimed in claim 1, wherein:

said upper roll has a center line that is defined as being an axis about which said upper roll rotates;

in said first groove of said upper roll, an outer flank surface is formed by a conical surface defining an angle $\alpha 1$ in the range of 55° to 75°, with a cylindrical reference surface centered on the center line of said upper roll; and/or in said first groove of said upper roll, an inner flank surface is formed by a conical surface defining an angle in the range of 45° to 65°, with a cylindrical reference surface centered on the center line of said upper roll, respectively of said lower roll.

13. The method as claimed in claim 1, wherein:

said upper roll has a minimum diameter in its first groove and a center line that is defined as being an axis about which said upper roll rotates;

said lower roll has a minimum diameter in its first groove and a center line that is defined as being an axis about which said lower roll rotates;

both center lines are separated by a distance;

a neutral rolling plane is defined as a plane parallel to the center lines of said upper and lower roll and located at half the distance between these center lines;

said first flange has a first coupling means along its free end, wherein a precursor of said first coupling means is rolled below said neutral rolling plane, and said lower roll has in this region a minimum diameter that is bigger than or equal to the minimum diameter of said lower roll in its first groove; and/or said second flange has a second coupling means, along its free end, wherein a precursor of said second coupling means is rolled above said neutral rolling plane, and said upper roll has in this region a minimum diameter that is bigger than or equal to the minimum diameter of said upper roll in its first groove.

14. The method as claimed in claim 1, wherein before said step of subsequently straightening said curved precursor of said web, said precursor of said Z-section sheet pile comprises:

a curved precursor of said first flange, which has in a cross-section substantially the form of a letter "J" that is slightly tilted to the right;

a curved precursor of said second flange, which has in a cross-section substantially the form of a letter "J" that is rotated clockwise by 180°;

said precursor of the first corner, which has an opening angle ($\alpha'$) greater than 90° but still smaller than the first corner in the final in the Z-section sheet pile°;

said precursor of the second corner, which has an opening angle ($\alpha'$) greater than 90° but still smaller than the first corner in the final in the Z-section sheet pile°; and said curved precursor of the web which includes a substantially flat first part connected to said precursor of the first corner, a central part comprising at least one wave trough and one wave crest, and a substantially flat second part connected to said precursor of the second corner.

15. The method as claimed in claim 14, wherein a straightened sheet pile leaves a roll gap defined by said upper and lower straightening rolls, said straightened sheet pile having a straightened first flange, a straightened second flange and a straightened web, and wherein:

said lower straightening roll includes:

a groove for receiving a first coupling means arranged along said straightened first flange;

a first conical section for entering in contact with an inner side of said straightened first flange;

a second conical section for entering in contact with a first side of said straightened web; and a third conical section for entering in contact with an outer side of said straightened second flange;

said upper straightening roll includes:

a first conical section for entering in contact with an outer side of said straightened first flange;

a second conical section for entering in contact with a second side of said straightened web;

a third conical section for entering in contact with an inner side of said straightened second flange; and a groove for receiving a second coupling means arranged along said straightened second flange;

wherein when said precursor of the Z-section sheet pile to be straightened is introduced between said upper straightening roll and said lower straightening roll:

said curved precursor of the first flange first rests with a convex corner portion against said first conical section of said lower straightening roll;

said curved precursor of the web first rests with its substantially flat first part against said second conical section of said upper straightening roll and with its substantially flat second part against said second conical section of said lower straightening roll, wherein the at least one wave trough and one wave crest are arranged in a roll gap section formed between said second conical section of said lower straightening roll and said second conical section of said upper straightening roll, without touching the latter; and said curved precursor of the second flange first rests with a convex corner portion against said third conical section of said upper straightening roll.

16. The method as claimed in claim 15, wherein:

said upper straightening roll has a center line that is defined as being an axis about which said upper straightening roll rotates;

said lower straightening roll has a center line that is defined as being an axis about which said straightening lower roll rotates;

both center lines are separated by a distance;

a neutral rolling plane for said upper straightening roll and lower straightening roll is defined as a plane parallel to the center lines of both straightening rolls and located at half the distance between these center lines; and said straightened first and second flanges are connected to said first and second coupling means by connections that are located close to said neutral rolling plane.

17. The method as claimed in claim 15, wherein, when said precursor of said Z-section sheet pile is introduced between said lower straightening roll and said upper straightening roll:

said convex corner portion of said curved precursor of the first flange is guided along said first conical section of said lower straightening roll towards said groove receiving said first coupling means;

said convex corner portion of said curved precursor of the second flange is guided along said third conical section of said upper straightening roll towards said groove receiving said second coupling means;

said substantially flat first part of said curved precursor of the web is guided along said second conical section of said upper straightening roll towards said first conical section of said upper straightening roll; and said substantially flat second part of said curved precursor of the web is guided along said second conical section of said lower straightening roll towards said third conical section of said lower straightening roll; and said at least one wave trough and said at least one wave crest are initially arranged in the entrance of the roll gap contour formed between said second conical section of said lower straightening roll and said second conical section of said upper straightening roll, without contacting said conical sections.

18. The method as claimed in claim 1, wherein:

before said precursor of the Z-section sheet pile is introduced between said lower straightening roll and an upper straightening roll, it is rotated about a longitudinal axis by an angle in the range between 5° and 45°.

19. The method as claimed in claim 1, wherein:

said precursor of the first corner has a center A;

said precursor of the second corner has a center B;

said first corner of the final Z-section sheet pile has a center A';

said second corner of the final Z-section sheet pile has a center B';

and if:

AB is a measured distance in the precursor of said Z-section sheet pile before straightening between the center A of the precursor of the first corner and the center B of the precursor of the second corner; and A' B' is a measured distance in the final sheet pile between the center A' of the first corner and the center B' of the second corner;

then the ratio A'B'/AB is in the range of 1.05 and 1.25.

* * * * *